United States Patent [19]

Mahoney et al.

[11] Patent Number: 5,039,109

[45] Date of Patent: Aug. 13, 1991

[54] PORTABLE MOUNTING STAND APPARATUS

[75] Inventors: Kenneth J. Mahoney; Thomas H. Mahoney, both of Dorrance, Kans.

[73] Assignee: Hadley Athletics, Inc., St. Louis, Mich.

[21] Appl. No.: 209,900

[22] Filed: Jun. 22, 1988

[51] Int. Cl.[5] ..... A63B 69/00

[52] U.S. Cl. ..... 273/395; 248/647; 280/763.1

[58] Field of Search ..... 273/1.5 R, 1.50 A, 395, 273/26 A, 29 A, 407; 248/647, 129, 98; 272/64; 280/299, 300, 763.1, 764.1

[56] References Cited

U.S. PATENT DOCUMENTS

| | | | |
|---|---|---|---|
| 1,063,620 | 6/1913 | Thornley | 272/64 |
| 2,379,476 | 7/1945 | Cleveland Jr. | 248/129 X |
| 2,939,705 | 6/1960 | McCall Jr. | 248/129 X |
| 3,427,025 | 2/1969 | Procter | 273/1.5 R |
| 3,675,914 | 7/1972 | Douglass | 248/647 X |
| 3,752,476 | 8/1973 | Mahoney | 273/1.5 A |
| 3,841,631 | 10/1974 | Dolan | 273/1.5 R |
| 3,917,203 | 11/1975 | Heubeck | 248/158 |
| 4,296,925 | 10/1981 | Alston | 273/1.5 A |
| 4,555,827 | 12/1985 | St. Louis | 248/129 X |
| 4,565,527 | 1/1986 | Burchett | 273/1.5 A X |

FOREIGN PATENT DOCUMENTS

| | | | |
|---|---|---|---|
| 544909 | 10/1959 | Belgium | 280/763.1 |
| 756921 | 4/1967 | Canada | 248/647 |
| 458824 | 12/1936 | United Kingdom | 280/763.1 |
| 870085 | 6/1961 | United Kingdom | 272/64 |

*Primary Examiner*—Paul E. Shapiro
*Attorney, Agent, or Firm*—Kalish & Gilster

[57] ABSTRACT

The portable mounting stand apparatus of this invention is adapted to receive a ball return apparatus for the like thereon and provide means for ease of movement from a portable transport condition to a rigid usage condition. The portable mounting stand apparatus includes a main support base assembly; a forward base support assembly secured to a forward portion of the main support base assembly; and a rearward base support assembly connected to a rear portion of the main support base assembly. The forward and rearward base support assemblies are each provided with support wheel assemblies to contact a support surface for ease of movability in the transport position. The rearward base includes a pivotal stationary support assembly having a pivotal stand support assembly which is selectively actuated to move support leg assemblies into and out of contact with the support surface. When in the rigid usage conditon, the pivotal stationary support assembly acts to elevate the rearward support wheel assemblies out of contact with the support surface so as to present a rigid nonmoving structure for use of the ball return apparatus, for example, on a basketball court in a basketball practice drill session.

12 Claims, 2 Drawing Sheets

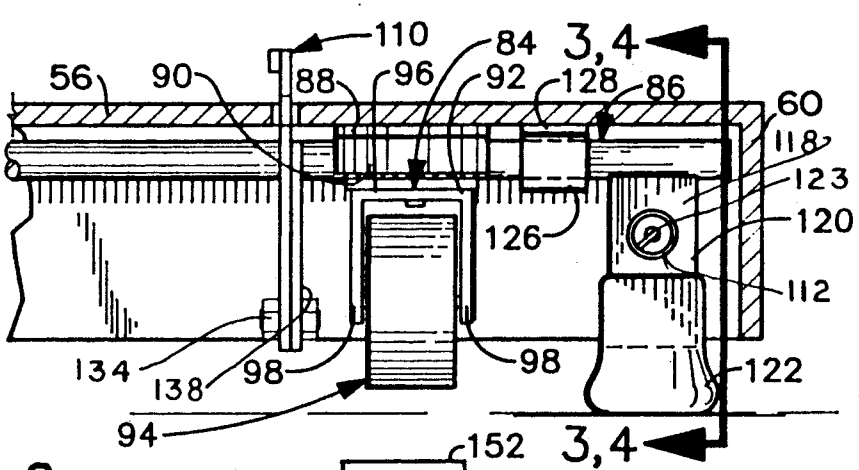
FIG. 2
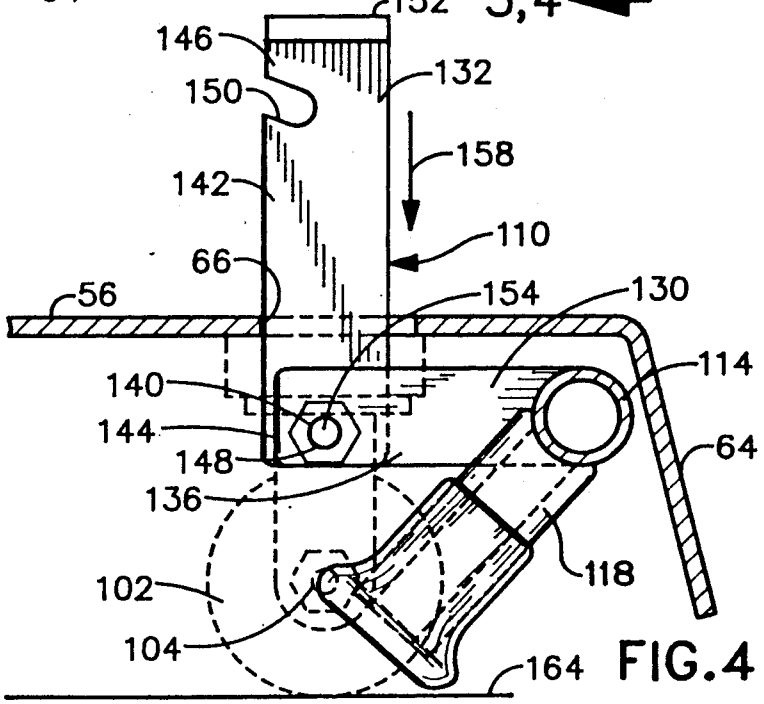
FIG. 4
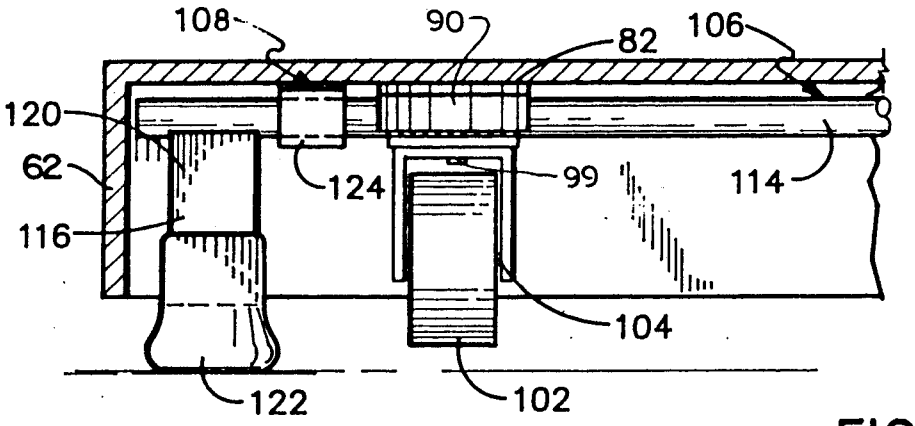
FIG. 3
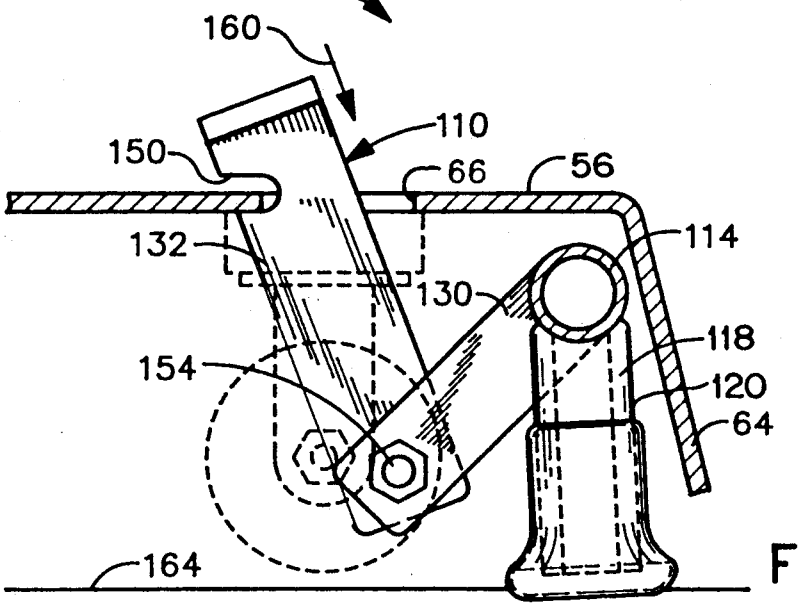

PORTABLE MOUNTING STAND APPARATUS

The Fred McCall, Jr. patent discloses a basketball practice device having the same environment and utilizes a bell crank structure.

SUMMARY OF THE INVENTION

Briefly, the invention comprises the following: a portable mounting stand apparatus is operable to receive and support a ball return apparatus thereon or other such structures which are desirable to move from a storage position to a rigid usage position. The ball return apparatus includes a support base assembly having a support post assembly extended upwardly therefrom and having a ball return assembly attached to an upper end of the support post assembly. The ball return assembly consists of a net member adapted to receive objects thrown thereagainst such as basketballs for use in a basketball practice system. The portable mounting stand apparatus includes 1) a main support base assembly; 2) a forward base support assembly secured to a forward portion of the main support base assembly; and 3) a rearward base support assembly secured to a rear portion of the main support base assembly. The main support base assembly includes a top support plate member to which the support post assembly of the ball return apparatus is secured. The forward base support assembly includes a pair of spaced support wheel assemblies which are extended parallel to each other and a longitudinal axis of the main support base assembly. The rearward base support assembly includes a pair of spaced rear support wheel assemblies and a pivotal stationary support assembly. The rear support wheel assemblies are freely rotatable and are movable into and out of contact with a support surface by the stationary support assembly. The stationary support assembly includes a pivotal support stand assembly connected through a mounting assembly to an undersurface of the main support base assembly and a stand actuator assembly. The stand actuator assembly includes first and second actuator link members which are pivotally movable from 1) a first condition contacting the support surface and maintaining the rear support wheel assemblies in elevated condition; and 2) to a second condition whereupon the rear support wheel assemblies are elevated out of contact with the support surface being a rigid support position.

OBJECTS OF THE INVENTION

One object of this invention is to provide a portable mounting stand apparatus operable to receive and support a ball return structure thereon which needs to be readily portable for movement from usage to storage positions.

One other object of this invention is to provide a portable mounting stand apparatus including rearward and forward base support assemblies having wheel support assemblies which are operable 1) to maintain all wheel support assemblies in contact with a support surface for ease of portability; and 2) to elevate one of the base support assemblies from the support surface and provide for anchor support leg assemblies to contact the support surface and restrict lateral movement of the entire portable mounting stand apparatus.

Still, another object of this invention is to provide a portable mounting stand apparatus which is operable to be easily moved from a solid support structure on a support surface to being supported on spaced support wheel assemblies for ease of movement on the support surface between storage and usage locations.

Another object of this invention is to provide a portable mounting stand apparatus including a pivotal stationary support assembly having support leg assemblies selectively movable into and out of contact with a support surface when changing from a mobile condition to a rigid support condition.

Still, one further object of this invention is to provide a portable mounting stand apparatus that is operable to receive numerous types of support structures thereon; easy to change from a rigid to a portable condition; sturdy in construction; economical to manufacture; and substantially maintenance free.

Various other objects, advantages, and features of the invention will become apparent to those skilled in the art from the following discussion, taken in conjunction with the accompanied drawings, in which;

BRIEF DESCRIPTION OF THE DRAWINGS

FIG. 2 is a fragmentary sectional view taken along line 2—2 in FIG. 1;

FIG. 3 is a fragmentary view taken along line 3—3 in FIG. 2 illustrating a rear support wheel assembly in an elevated condition above a support surface in dotted lines; and FIG. 4 is a fragmentary sectional view taken along line 4—4 in FIG. 2 similar to FIG. 3 except illustrating a rear support wheel assembly 3 contacting the support surface in dotted lines.

Figure 1:
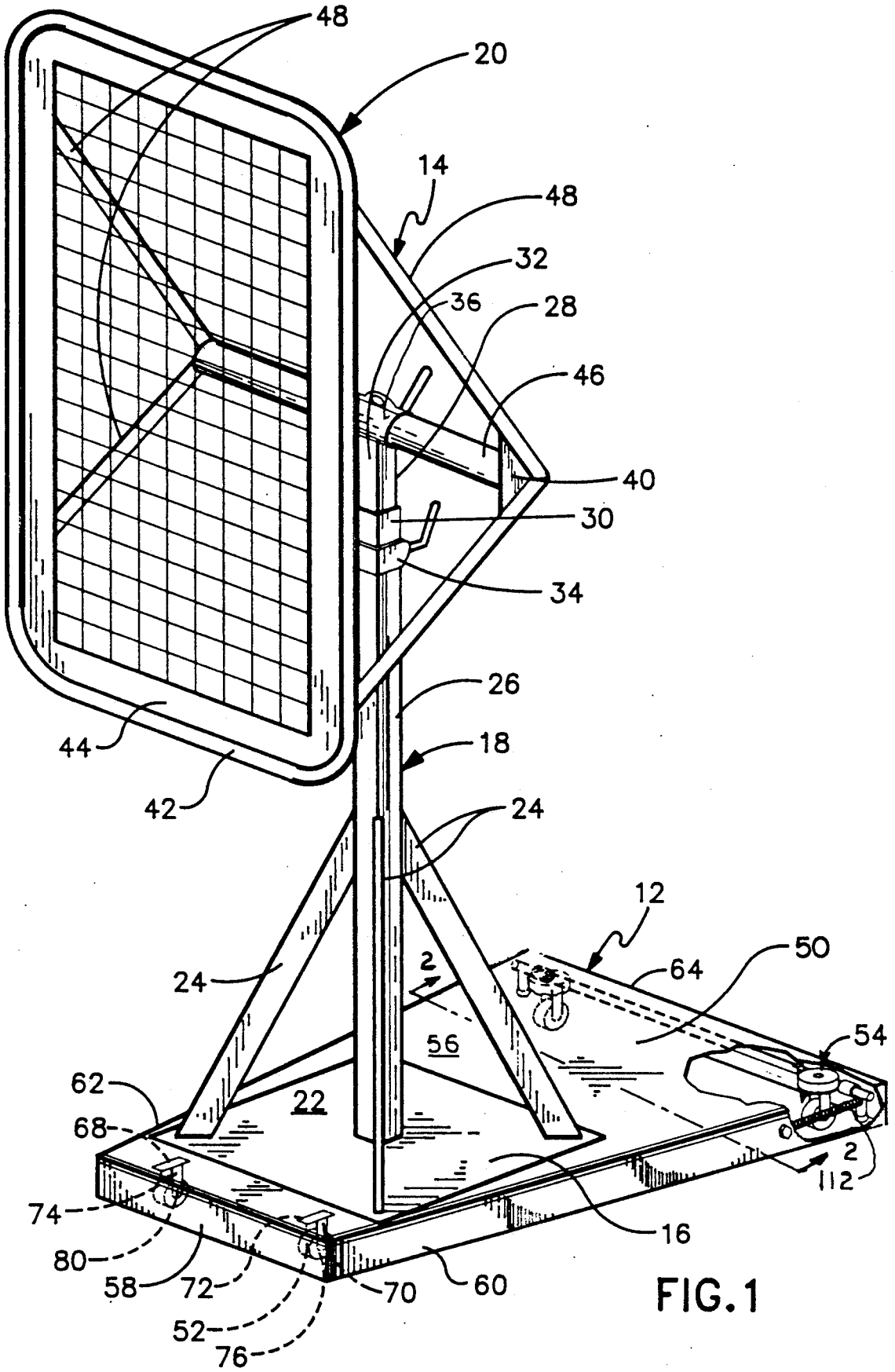
FIG. 1 is a perspective view of a portable mounting stand apparatus of this invention having a ball return apparatus mounted thereon.

The following is a discussion and description of the portable mounting stand apparatus of this invention, such being made with reference to the drawings, whereupon the same reference numerals are used to indicate the same or similar parts and/or structure. It is to be understood that such discussion and description is not to unduly limit the scope of the invention.

PREFERRED EMBODIMENT OF THE INVENTION

Referring to the drawings in detail and, in particular to FIG. 1, a portable mounting stand apparatus of this invention, indicated generally at 12, is operable to receive and support a structure thereon such as a ball return apparatus 14. It is to be understood that the portable mounting stand apparatus 12 is constructed to receive and support many structures thereon but the ball return apparatus 14 illustrates one embodiment of use of the invention.

As noted in FIG. 1, the portable ball return apparatus 14 includes 1) a support base assembly 16; 2) a support post assembly 18 having a lower end secured to the support base assembly 16; and 3) a ball return assembly 20 adjustably connected to an upper end of the support post assembly 18. The support base assembly 16 includes a generally square base plate member 22 of sheet material and having, interconnected at outer ends thereof, spaced support struts 24 which are connected at an upper end as by welding to the support post assembly 18.

The support post assembly 18 includes an anchor post member 26 having an adjustable post assembly 28 connected thereto. The anchor post member 26 is of a generally sectanguluare tubular shape in transverse cross section having a lower end portion secured as by welding to a center upper portion of the base plate member 22.

The adjustable post assembly 28 is of a telescoping nature having first and second telescoping post members 30, 32; a post lock assembly 34; and a return lock assembly 36. The first post member 30 is telescoping received within the anchor post member 26 while the second post member 32 is telescoped within the first post member 30. Due to the telescoping construction, the ball return assembly 20 can be adjusted to a desired vertical height relative to the support base assembly 16.

The post lock assembly 34 is a conventional mechanism to releasably lock the first post member 30 to the anchor post member 26. Similarly, the return lock assembly 36 is operable to selectively lock the ball return assembly 20 to an upper portion of the second post member 32.

The ball return assembly 20 as shown in the prior art (U.S. Pat. No. 3,752,476) includes 1) a basic support frame 40; 2) a net frame assembly 42 connected to the basic support frame 40; and 3) a net member 44 of a resilient material connected to and extended between the net frame assembly 42.

The basic support frame 40 includes a horizontal strut member 46 having frame support structures 48 connected to outer opposite ends thereof which, in turn, are connected to the net frame assembly 42.

The net frame assembly 42 has a frame body of a generally rectangular shape to support the net member 44 therebetween.

Net frame assembly 42 can be adjusted angularly through the use of the return lock assembly 36 and the vertical height thereof can be adjusted through the use of the post lock assembly 34.

Although the ball return assembly 20 of this invention is utilized in basketball practice drill systems, various sizes and types of ball return assemblies can readily be utilized for the practice of soccer, softball, football, and other such uses.

The portable mounting stand apparatus 12 includes 1) a main support base assembly 50; 2) a forward base support assembly 52 connected to a forward portion of the main support base assembly 50; and 3) a rearward base support assembly 54 connected to a rearward portion of the main support base assembly 50. The main support base assembly 50 includes 1) a top support plate member 56 of generally trapezoidal shape; 2) a front wall member 58 integral with a forward portion of the top support plate member 56; 3) a pair of parallel spaced side wall members 60, 62 integral with rearwardly divergent edges of the top support plate member 56; and 4) a rear wall member 64 integral with a rear portion of the top support member 56. It is noted that the front wall member 58 and rear wall member 64 are integral with the side wall members 60, 62 and all are downwardly depending from the top support plate member 56 to a position adjacent a support surface to provide a protective enclosure.

The forward base support assembly 52 (shown in FIG. 1) includes a pair of spaced support wheel assemblies 68, 70 mounted against a forward undersurface of the top support member 56 as noted in FIG. 1. Each of the support wheel assemblies 68, 70 are provided with a main support plate 72; a pair of downwardly extending parallel connector lugs 74; and a wheel assembly 76 rotatably mounted between the connector lugs 74. Each wheel assembly 76 includes a wheel member 78 rotatably mounted on respective support shafts 80. It is noted that the support wheel assemblies 68, 70 are of a nonrotatable type (about a vertical axis) with the axis of the support shafts 80 extended in a plane parallel to the front wall member 58.

The rearward base support assembly 54 includes 1) a pair of spaced rear support wheel assemblies 82, 84 secured to an undersurface of a rearward portion of the top support plate member 56; and 2) a pivotal stationary support assembly 86 positioned adjacent the rear support wheel assemblies 82, 84.

Referring to FIG. 2, each of the rear support wheel assemblies 82, 84 includes 1) a main support plate member 88 secured to an undersurface of the top support plate member 56; 2) a bearing assembly 90 secured to the support plate member 88; 3) a wheel support member 92 secured to a lower surface of the bearing assembly 90; and 4) a pivotal wheel assembly 94 connected to the wheel support member 92. The bearing assembly 90 is of a substantially conventional nature mounted between the support plate member 88 and the wheel support member 92 allowing the wheel support member 92 to rotate 360 degrees.

The wheel support member 92 is provided with a main connector base 96 having a pair of downwardly spaced connector lugs 98 and secured by an anchor member 99 to the bearing assembly 90.

The pivotal wheel assembly 94 includes a wheel member 102 mounted on a shaft member 104 for rotation of movement thereabout.

The pivotal stationary support assembly 86 includes 1) a pivotal stand support assembly 106; 2) a mounting assembly 108 to rotatably receive the pivotal stand support assembly 106 therein and secure same to the undersurface of the main top support plate member 56 of the main support base assembly 50; 3) a stand actuator assembly 110 which is connected to the pivotal stand support assembly 106 and operably engagable with the top support plate member 56; and 4) spring biasing means 112 connected between the pivotal stand support assembly 106 and the main support base assembly 50.

The pivotal stand support assembly 106 includes a main support shaft member 114 rotatably mounted within the mounting assembly 108 and having support leg assemblies 116, 118 fixedly secured at opposite ends thereof.

Each of the support leg assemblies 116, 118 includes a main support leg 120 having a resilient cap member 122 secured to an outer end thereof and an inner end for fixed securement to the main support shaft member 114. The support leg assembly 118 is provided with a hole 123 therein to receive and connect to one end of the biasing means 112.

The mounting assembly 108 includes a pair of spaced bearing members 124, 126 to rotatably receive the main support shaft 114 therein and is operable for connection as by welding bearing members 124, 126 to the undersurface of a rearward portion of the top support plate member 56.

The stand actuator assembly 110 includes 1) a first actuator link 130 having one end fixedly secured to the main support shaft member 114 of pivotal stand support assembly 106; 2) a second actuator link 132; and 3) a connector member 134 to pivotally connect adjacent ends of the first and second actuator links 130, 132 (see FIGS. 3 and 4).

The first actuator link 130 includes a main body 136 having an integral connector section 138. The connector section 138 is provided with a connector opening 140.

The second actuator link 132 is provided with a main link body 142 having an integral connector section 144 at one end and a latch section 146 at the opposite end. The connector section 144 is provided with a connector hole 148 which, with the connector opening 140, is adapted to receive the connector member 134 therethrough.

The latch section 146 is provided with an inclined latch notch 150 and an actuator tab 152 at the upper end thereof for reasons to be explained.

The connector member 134 is a nut and bolt member 154 pivotally interconnecting the adjacent ends of the first and second actuator links 130, 132.

USE AND OPERATION OF THE INVENTION

In the use and operation of the portable mounting stand apparatus 12 of this invention, a ball return apparatus 14 or other similar structure can be mounted on the upper surface of the top support member 56. The main purpose and function of the portable mounting stand apparatus 12 is to provide a means of easily moving the entire structure from usage to storage positions. The previous mounting stand structures for similar uses utilize suction cup members which present numerous problems in unexpectantly releasing from a support surface 164. It is noted that the present support wheel assemblies 68, 70 are aligned for normal movement in a direction parallel to a longitudinal axis of the top support member 56. The rear support wheel assemblies 82, 84 are of a 360 degree pivotal type and are spaced outwardly of the front support wheel assemblies 68, 70 which provides a new and novel result aiding in the transport and steerability of the entire portable mounting stand apparatus 12.

First, we will assume that the stand actuator assembly 110 is in a retracted position as noted in FIG. 4. In this retracted position, the front support wheel assemblies 68, 70 and rear support wheel assemblies 82, 84 are in contact with the ground, floor or other support surface 164. In this condition, ball return assembly 20 can be grasped for ease of steering and movement of the entire portable mounting stand apparatus 12 onto a basketball court playing surface or the like. The operator can move the then portable mounting stand apparatus 12 into a position in which the structure is to can be utilized, for example, in a basketball practice drill session.

In order to transfer the portable mounting stand apparatus 12 into a rigid or usage condition, a downward force is placed on the actuator tab 152 (as by the operator's foot member) of the second link member 132 to force movement thereof in a downward direction as noted by arrow 158 in FIG. 4. On such downward movement, support leg assemblies 116, 118 are pivotal in a counterclockwise motion as noted in FIG. 4. Concurrently, the second actuator link 132 is being moved downwardly as noted by arrow 160 and forwardly in a direction opposite to arrow 162 as shown in FIG. 3. The inclined lock notch 150 upon link 132 engages the adjacent surface around the actuator slot 66 in the top support plate 56.

In this usage condition, seen in FIG. 3, the bottom surface of the cap members 122 are in contact with the support surface 164 and, in fact, the support legs 120 are inclined slightly forwardly to a line perpendicular from the support surface 164 through the center of the main support shaft 114. This inclination aids in restricting rearward movement of the entire portable mounting stand apparatus 12.

In order to transfer the pivotal stationary support assembly 86 from the rigid usage condition (FIG. 3) to the transport condition (FIG. 4), actuator tab 152 is to be pressed downwardly as noted by arrow 160 with a concurrent forward movement of assembly 12 in a direction as indicated by arrow 162. Due to a biasing means 112 being the tension spring member mounted between the support leg assembly 118 and the side wall 60 of the main support base assembly 50, rotation of the main support shaft member 114 occurs in a clockwise direction as noted in FIG. 3 so as to position the support leg assemblies 116, 118 in the transport condition as noted in FIG. 4. The biasing means 112 then holds the support leg assemblies 116, 118 in the transport, or retracted, positions.

It is found that on moving of the pivotal stationary support assembly 86 from the rigid usage position of FIG. 3 to the transport position of FIG. 4, it is beneficial to slightly move the entire portable mounting stand apparatus 12 rearwardly while conjointly depressing the actuator tab 152 as noted by arrow 160, as previously described. This movement aids in conjunction with the biasing means 112 to pivot the support leg assemblies 116, 118 to the transport condition of FIG. 4.

It is seen that the portable mounting stand apparatus of this invention is readily movable with a minimum amount of effort from the transport condition to the rigid usage condition with a minimum amount of skill and effort required to do so. The portable mounting stand apparatus can be readily transported and moved by one person and, by virtue of the relatively wide rear base portion and substantially enclosed base surface, reduces considerably the chances of any injuries to the operator thereof. The portable mounting stand apparatus is simple to use; sturdy in construction; economical to manufacture; and substantially maintenance free.

While the invention has been described in conjuction with preferred specific embodiments thereof, it should be understood that this description is tended to illustrate and not to limit the scope of the invention, which is defined by the following claims:

I claim:

1. A portable mounting stand apparatus for mounting a game skills practice structure thereon, comprising:

a) a main support base assembly being provided with such practice structure mounted thereon;

b) a forward base support assembly being provided with a support wheel assembly connected to said main support base assembly and operably in contact with a support surface;

c) a rearward base support assembly including a rear support wheel assembly operable to contact the support surface and a stationary support assembly connected to said main support base assembly;

d) said stationary support assembly including a pivotal stand support assembly having a support leg assembly pivotal from a transport condition out of engagement with the support surface to a usage condition in engagement with the support surface and concurrently elevating said rearward support wheel assembly out of contact with the support surface to restrict lateral movement of said portable mounting stand apparatus;

e) said pivotal stand support assembly including a main support shaft member rotatably connected to said main support base assembly having said support leg assembly connected thereto and a stand actuator assembly connected to said main support shaft member operable to move said support leg assembly from the transport condition to the usage condition;

f) said stand actuator assembly, including first and second actuator links each having opposite ends thereto and which are pivotally connected to each other at one of the respective ends thereof; the other end of said first link member being secured to said main support shaft member; and said second link member being engageable near the other end thereof with said main support base assembly when in the transport condition.

2. A portable mounting stand apparatus as described in claim 1, wherein said support wheel assembly of said forward base support assembly is provided with a wheel member rotatable about a horizontal axis and non-rotatable about a vertical axis to limit freedom of movement in one direction.

3. A portable mounting stand apparatus as described in claim 1, wherein said rear support wheel assembly is provided with a wheel member rotatable about a horizontal axis and freely rotatable about a vertical axis for ease of movement in all lateral directions.

4. A portable mounting stand apparatus as described in claim 1, wherein said second actuator link is provided with a latch section therein which is engageable with said main support base assembly to hold same in the usage condition and elevating said rear support wheel assembly out of contact with the ground surface.

5. A portable mounting stand apparatus as described in claim 4, wherein said latch section is provided with an inclined latch notch; said notch being engageable with said support base assembly to hold said support leg assembly engagedly with the ground surface.

6. A portable mounting stand apparatus as described in claim 1, wherein said main support base assembly is provided with an actuator slot to receive said pivotal stand actuator assembly therethrough and being selectively engageable therewith to anchor said actuator assembly in the usage condition and allow passage of said actuator assembly through said actuator slot when in the transport condition.

7. A portable mounting stand apparatus as described in claim 1, wherein said stationary support assembly includes biasing means engageable with said pivotal stand support assembly and said main support base assembly to bias said support leg assembly toward the transport condition.

8. A portable mounting stand apparatus for mounting a game skills practice structure thereon, comprising:

a) a main support base assembly being provided with such practice structure mounted thereon;

b) a forward base support assembly being provided with spaced support wheel assemblies connected to said main support base assembly and operably in contact with a support surface;

c) a rearward base support assembly including spaced rear support wheel assemblies operable to contact the support surface and a stationary support assembly, all connected to said main support base assembly; and d) said stationary support assembly including a pivotal stand support assembly being provided with spaced support leg assemblies pivotal from a transport condition out of engagement with the support surface with said portable mounting stand apparatus supported solely on said forward base support assembly and said rearward base support assembly to a usage condition engageably with the support surface and concurrently elevating said rear support wheel assemblies out of contact with the support surface to restrict lateral movement of said portable mounting stand apparatus;

e) said main support base assembly being provided with an actuator slot therein positioned adjacent said rearward support wheel assemblies;

f) said pivotal stand support assembly including a main support shaft member rotatably connected to said main support base assembly and having said support leg assemblies connected to adjacent opposite outward ends thereof;

g) said stationary support assembly including a stand actuator assembly having first and second actuator links each having opposite ends thereto;

h) said first actuator link having one end secured to said main support shaft and the opposite end pivotally connected to said second actuator link; and i) said second actuator link being provided with one end extended through said actuator slot in said main support base assembly and being operable on movement thereof to rotate said support leg assemblies from the usage condition to the transport condition.

9. A portable mounting stand apparatus as described in claim 8, wherein said second actuator link is provided with a latch section which is selectively engageable with an adjacent portion of said main support base assembly about said actuator slot to lock said stationary support assembly in the upright usage condition to elevate said rearward support wheel assemblies out of contact with the ground surface to render said portable mounting stand apparatus in the rigid, laterally non-moving usage condition.

10. A portable mounting stand apparatus as described in claim 8, wherein said support wheel assemblies are positioned adjacent a forward portion of said main support base assembly and extending parallel to the normal movement along a longitudinal axis of said main support base assembly; and said rear support wheel assemblies are positioned adjacent a rearward portion of said main support base assembly outwardly of the parallel planes of movement of said support wheel assemblies.

11. A portable mounting stand apparatus as described in claim 10, wherein said support leg assemblies are positioned outwardly of respective ones of said rear support wheel assemblies to provide stability and hinder any movement of said support wheel assembly when in the usage condition.

12. A portable mounting stand apparatus adapted to be readily transformed from a freely movable transport condition to a rigid usage condition upon a support surface comprising:

a) a main support base assembly;

b) a first base support assembly having support wheel assemblies connected to said main support base assembly and operably in contact with the support surface;

c) a second base support assembly including second support wheel assemblies in contact with the support surface and a stationary support assembly;

d) said stationary support assembly including a pivotal stand support assembly having support leg assemblies selectively movable from a transport condition out of contact with the support surface to a usage condition in contact with the support surface and concurrently elevating the second base support assembly to provide a rigid non-moving condition to said portable mounting stand apparatus;

e) said stationary support assembly including a bias means connected between said main support base assembly and said pivotal stand support assembly in order to bias said support leg assemblies out of contact with the ground surface;

f) said stationary support assembly including a stand actuator assembly connected to said stand support assembly and operably engageable with said main support base assembly;

g) said stand actuator assembly being operable in the transport condition to permit rotation of said support leg assembly to a raised position out of contact with the support surface under force of said bias means;

h) said stand actuator assembly further being operable in the usage condition to rotate said support leg assemblies into contact with and support on the support surface while raising said second support wheel assembly out of contact with the support surface; and i) said stand actuator assembly including first and second link members pivotally connected to each other; secured to said support leg assemblies; and selectively engageable with said main support base assembly in the usage condition.

* * * * *